US006061927A

United States Patent [19]

Ijäs et al.

[11] Patent Number: 6,061,927

[45] Date of Patent: May 16, 2000

[54] METHOD FOR CONTROLLING CURL OF PAPER IN A DRYER SECTION OF A PAPER MACHINE

[75] Inventors: Vesa Ijäs, Viiala; Kari Juppi, Palokka; Pasi Ahonen, Jyväskylä ; Jaakko Kallioniemi, Muurame, all of Finland

[73] Assignee: Valmet Corporation, Helsinki, Finland

[21] Appl. No.: 09/286,752

[22] Filed: Apr. 6, 1999

Related U.S. Application Data

[62] Division of application No. 09/049,393, Mar. 27, 1998
[60] Provisional application No. 60/042,421, Mar. 27, 1997.

[30] Foreign Application Priority Data

Mar. 27, 1997 [FI] Finland ..... 971301

[51] Int. Cl.[7] ..... D21F 5/00; F26B 11/02

[52] U.S. Cl. ..... 34/446; 34/448; 427/209; 427/210

[58] Field of Search ..... 34/445, 446, 448, 34/451, 454, 114, 115, 117, 118, 120, 125, 128; 427/316, 229, 210, 211; 162/275, 289

[56] References Cited

U.S. PATENT DOCUMENTS

| | | | |
|---|---|---|---|
| 4,441,263 | 4/1984 | Vedenpaa | 34/115 |
| 4,516,330 | 5/1985 | Eskelinen et al. | 34/23 |
| 4,905,380 | 3/1990 | Eskelinen et al. | 34/23 |
| 5,022,163 | 6/1991 | Ilvespaa et al. | 34/23 |
| 5,172,491 | 12/1992 | Ilvespaa et al. | 34/115 |
| 5,416,980 | 5/1995 | Ilvespaa | 34/117 |
| 5,557,860 | 9/1996 | Kotitschke et al. | 34/455 |
| 5,632,101 | 5/1997 | Oeschle | 34/445 |
| 5,647,141 | 7/1997 | Hanaya | 34/115 |
| 5,756,156 | 5/1998 | Elijoki et al. | 427/316 |
| 5,771,603 | 6/1998 | Kotitschke et al. | 34/446 |
| 5,884,415 | 3/1999 | Sims et al. | 34/446 X |
| 5,925,407 | 7/1999 | Ostman | 427/209 |

FOREIGN PATENT DOCUMENTS

| | | |
|---|---|---|
| 91900 | 6/1992 | Finland . |
| 98387 | 8/1996 | Finland . |
| 963734 | 1/1997 | Finland . |
| 964830 | 1/1997 | Finland . |

*Primary Examiner*—Stephen Gravini
*Attorney, Agent, or Firm*—Steinberg & Raskin, P.C.

[57] ABSTRACT

A method in a dryer section of a paper or board machine for controlling curl of paper, in which steam treatment and/or moistening of the paper web is/are employed. The operations carried out in order to control the curl of the paper web are carried out in a number of stages when the web temperature is, during at least one stage, lower than 85° C., preferably lower than 75° C., and when the dry solids content of the web is in the range of K1–K2, wherein K1 is the ultimate dry solids content of the web −7% and K2 is the ultimate dry solids content +3%.

16 Claims, 3 Drawing Sheets

METHOD FOR CONTROLLING CURL OF PAPER IN A DRYER SECTION OF A PAPER MACHINE

CROSS REFERENCE TO RELATED APPLICATION

This application is a divisional of U.S. patent application Ser. No. 09/049,393 filed Mar. 27, 1998 which claims priority of U.S. provisional patent application Ser. No. 60/042,421 filed Mar. 27, 1997.

FIELD OF THE INVENTION

The present invention relates to a method in a dryer section of a paper or board machine for controlling curl of paper, in which steam treatment and/or moistening of the paper web is/are employed.

BACKGROUND OF THE INVENTION

In the prior art, in multi-cylinder dryers of paper machines, twin-wire draw and/or single-wire draw is/are employed. When employing twin-wire draw, a group of drying cylinders comprises two closed (endless) wires, fabrics or belts which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire. Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders or rolls are placed in a lower row below the upper row of drying cylinders, which rows are typically horizontal and parallel to one another. In the following, when the terms "normal (dryer) group" and "inverted (dryer) group" are used, what is meant is expressly groups with single-wire draw in multi-cylinder dryers, of the type mentioned above. In an inverted dryer group, the heated drying cylinders are placed in a lower row and the reversing cylinders or rolls are placed in an upper row above the lower row of drying cylinders.

It is known to those skilled in the art that if paper is dried one-sidedly, the result is a tendency of curling of the sheet. For example, when paper is dried by means of normal groups with single-wire draw from the side of its bottom face only, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

As known in the prior art, the tendency of curling of paper (or the tendency to curl) is already affected in connection with the web formation, in particular at the sheet formation stage (in, for example, the current assignee's former designated Sym-Former™) by means of the selection of the difference in speed between the slice jet and the wire, by means of the choice of the former and its mode of running, and also by means of other running parameters. For example, in the case of copying paper, by means of unequal-sidedness of drying in the after-dryer, a suitable initial curl form is regulated for the sheet in order that the curling of the paper after one-sided or double-sided copying could be optimized. In the case of copying paper, the reactivity of curling, i.e., the extent to which curling occurs per unit of change in moisture content, is affected to a greater extent by means of a multi-layer structure of the paper, which is produced in connection with the web formation in the wet end.

The most recent technology related to the present invention in high-speed paper machines is based on dryer sections in which there is single-wire draw over the major part of the length of the machine and, with a view toward controlling the tendency of curling of paper, in practice, an inverted group is also almost always used in order to make the drying sufficiently symmetric in the z-direction. However, it has been found that an inverted group has certain obvious, inherent drawbacks in view of the runnability and the overall efficiency of the machine and in view of the profitability of the paper machine investment. Thus, from the point of view of the runnability of the paper machine, a dryer section fully supported over its entire length and based on the use of only normal groups with single-wire draw, without using any inverted groups, would be a highly justified solution. People skilled in the art have, however, not had the courage to introduce this solution in operation, because it has been considered that it would result in uncontrollable and unfavorable constructions from the point of view of the tendency of curling of paper.

One particular problem in the prior art dryer section constructions that include one or more inverted dryer groups is the removal of broke in the event of web breaks, because inverted groups are not self-cleaning by the effect of gravity.

With respect to the prior art related to the present invention, reference is made to the current assignee's Finnish Patent No. 91,900 (corresponding to U.S. Pat. No. 5,416,980 incorporated by reference herein), in which a method is described in the dryer section of a paper machine in particular for reducing the tendency of curling of paper. In this method, the paper web is dried by means of drying cylinders against whose heated faces the paper web is pressed by means of a drying wire. In the dryer section, groups of drying cylinders are used in which twin-wire draw and/or single-wire draw is/are applied. In this method, it has been considered advantageous that in the dryer section, substantially across the entire width of the paper web, hot water steam is fed, by whose means the strains that arise or tend to arise in the fiber mesh in the paper web are relaxed by means of heat and moisture in, or substantially directly after, the area of formation of the strains.

In the current assignee's Finnish Patent Application No. 963734 (corresponding to U.S. provisional patent application Ser. No. 60/030,693), a method is described for drying a surface-treated paper web or equivalent in an after-dryer of a paper machine as well as a dryer section of a paper machine for applying the method. With a view toward compensating for a tendency of curling of the paper web, in the after-dryer, the paper web is dried in a dryer group/ groups making use of a normal single-wire draw. In connection with or after the drying, the paper web is treated by means of at least one device in order to compensate for a tendency of curling of the paper web, which devices are, for example, a steam box, a blower unit, a moistening device, and/or a soft calender.

Further, in the current assignee's Finnish Laid-Open Publication No. 98,387 (corresponding to U.S. patent application Ser. No. 08/705,059, incorporated by reference herein), a method is described for the manufacture of paper, in particular fine paper, to be surface-treated as well as a dry end of a paper machine that makes use of the method. The paper web, which has been dewatered by pressing, is dried in a forward dryer section, in which drying energy is applied to the paper web over the entire length of the forward dryer section asymmetrically in the z-direction from the side of the lower face of the web. This forward drying stage is carried out by means of a number of successively arranged groups with single-wire draw open towards the bottom on the support of the drying wire. In this manner, shrinkage of the web, which tends to take place both in the machine direction and in the cross direction with an increase in the dry solids content, is substantially prevented. In connection with a web break, the paper broke is removed downwards from the dryer groups open towards the bottom substantially by the force of gravity onto the broke conveyor placed underneath. Owing to the asymmetric forward drying, the paper web with a tendency of curling is passed into a finishing section, in which it is after-treated while it is, at the same time, moistened or worked plastically so that the tendency of curling that arose in it in the forward drying stage is eliminated. The after-dryer section may include groups with twin-wire draw and regulation of steam as well as steam boxes arranged to control the curl and infra and airborne web drying.

In the current assignee's Finnish Patent Application No. 964830 (corresponding to U.S. provisional patent application Ser. No. 60/032,405), a method is described for drying paper as well as a dry end of a paper machine. The method for drying paper comprises the following steps: the paper web to be dried is passed from the press section into a forward dryer section, in which the paper web is dried from the side of its bottom face in dryer groups that apply a normal single-wire draw, the forward dryer section comprising exclusively single-wire groups with normal single-wire draw, and from the forward dryer section the paper web is passed into a finishing section. In the finishing section, the paper web is coated/surface-sized by means of a coating/surface-sizing equipment, thereafter dried in an after-dryer section by passing through at least one dryer group that applies a normal single-wire draw. After the after-dryer section, the paper web is calendered in a calender and passed to a reeling station in which the paper web is reeled into a machine reel. The curling of the paper web is controlled by means of elements and/or by means of assemblies and combinations formed out of such elements in the area of the forward dryer section and/or the finishing section. The dry end of the paper machine comprises a forward dryer section and a finishing section, which finishing section comprises a coating/surface-sizing equipment, an after-dryer, a calender, and a reeling station. The dry end of the paper machine comprises elements and/or assemblies and combinations formed out of such elements arranged to control curling of the paper web in the area of the forward dryer section and/or the finishing section. The elements for controlling the curl of the web include, among other things, blowing of hot moist air through the wire in the forward dryer section, steam boxes employed in the after-dryer, a combination in which steam treatment by means of a steam box is combined with a cooling cylinder, a lower support belt or support wire in the after-dryer, twin-wire groups employed in the after-dryer, blowing through the wire in connection with at least one cylinder in the after-dryer, the use of a suitable cylinder-diameter ratio, atomizing of water against the web in the after-dryer, infrared boxes for treatment of the web before the calender, transfer of moist air from the forward dryer to the after-dryer to be blown against the web, and mechanical working of the web by means of a spreader bar.

With respect to the prior art, reference is also made to U.S. Pat. No. 5,557,860 which describes a dryer section including dryer groups with a normal single-wire draw and a moistening device arranged after the dryer groups and by means of which the curl of the web is controlled.

OBJECTS AND SUMMARY OF THE INVENTION

It is an object of the present invention to provide new and improved methods for controlling curl of paper in a dryer section of paper and board machines.

It is another object of the present invention to provide a method for drying a web in a paper machine in which inverted groups are not needed at all and not used, but which, however, meets all other commercial requirements that are imposed on the drying of a paper web.

Another object of the present invention is to approach the problems of drying a paper web from a new point of view and to suggest novel solutions for these problems, which solutions are somewhat contrary to conventional modes of thinking.

It is still another object of the present invention to further develop the prior art constructions and methods described above in order that it should be possible to control curl of a paper or board web in the dry end of the paper machine more efficiently.

It is a further object of the present invention to provide a method for drying a paper machine using finishing devices in which the runnability of the web can be brought to a particularly high level.

In view of achieving the objects stated above and others, in the method in accordance with the invention, the operations carried out in order to control the curl of the paper web are carried out in a number of stages, before the finishing device that works the web mechanically, while the web has a dry solids content in a range of from K1 to K2, wherein K1 is the ultimate dry solids content of the web −7% and K2 is the ultimate dry solids content +3%, and when the temperature of the web is, during at least one stage, lower than 85° C., preferably lower than 75° C.

In a paper or board machine in accordance with the invention, there are at least two curl regulation devices in order to achieve regulation of the curl in a number of stages, and the operations carried out in order to control the curl of the paper web are carried out in a number of stages before the finishing device that works the web mechanically. Each curl regulation device is operative on the web while the dry solids content of the web is in the range of K1–K2, wherein K1 is the ultimate dry solids content −7% and K2 is the ultimate dry solids content +3%. The curl regulation device in at least one curl control stage is operative on the web when the web temperature is lower than about 85° C., preferably lower than about 75° C.

In accordance with the invention, the curl is regulated when the web temperature is lower than 85° C., preferably lower than 75° C. This temperature limitation is important since steam condenses into the web more efficiently when the web temperature has been lowered to a level below about 85° C., preferably below about 75° C. In relation to this, experiments with a production machine have been carried out and it has been found that when the last upper cylinder in the dryer section is hot, a steam box placed directly after this cylinder had no major effect on the curl. However, when the supply of steam into this cylinder is closed, the temperature of the web became lower, and a significant effect was produced by the steam box, i.e., while the web temperature was lower than about 85° C.

Moreover, the curl of the paper web is regulated in the final end of the drying process. It has been found that an excessive drying promotes the control of the curl when moistening/steam treatment is employed. According to the invention, optimal controllability is obtained in a range of dry solids content that extends from about 7% lower than the desired ultimate dry solids content to about 3% above the desired ultimate dry solids content. In the case of surface-sized fine paper, this range is typically from about 88% to about 98%, the ultimate dry solids content being 95%.

Further, according to the invention, the curl regulation operations, such as steam treatment/moistening and cooling of the web, are carried out in a number of stages, in which case a highly efficient curl regulation effect is obtained. This comes out from the accompanying FIG. 3, discussed in greater detail below, from whose test results it comes out that a web that has been dried from one side only is curled intensively (20 units). A mere steam treatment in one stage reduces the curl substantially, but the web is still curled in the original direction by about 5 units. When the web has been moistened slightly before the steam treatment, the web curl direction can be even reversed.

A moistening device is highly efficient in lowering the web temperature. In some applications, e.g., a cooling cylinder can be substituted for by a moistening device.

In an arrangement in accordance with the present invention, the dry end of the paper machine is preferably exclusively based on dryer groups with single-wire draw, in which case the removal of broke takes place constantly by the force of gravity and thus does not cause any broke removal problems. Likewise, in single-wire draw, the paper web is constantly supported by a wire, in which case the runnability is improved and it is possible to increase the speed. In view of controlling the unequalsidedness of paper and in particular the curl arising from unequalsided drying, in the after-dryer in the dry end of the paper machine, curling tendency control elements have been provided for controlling the tendency of curling of the web in accordance with the principles described above so that the desired curl is obtained for the paper.

According to an exemplifying embodiment of the invention, in the after-dryer, for the control of the curl, cylinders which can be cooled and/or whose temperature can be regulated as well as moistening or steam boxes are used, which have been placed alternatingly so as to provide a multi-stage cooling/moistening-curl cycle, together with an optimal roll/cylinder diameter as a combination formed in a favorable manner. In prior art arrangements, it is affected by means of optimization of the cylinder-roll diameter ratio that when the diameter of a suction roll is made larger, the evaporation taking place through the lower face is increased, and the vice versa. A favorable feature of the invention is the choice of a suitable cylinder-roll diameter ratio so that, when the web runs around a suction roll or equivalent of larger diameter, the web temperature is lowered. After this, for example, a steam box is arranged so as to provide moistening in view of regulation of the curl.

The paper web is preferably also cooled primarily from the bottom side when the forward dryer and the after-dryer in the dryer section are provided with a normal single-wire draw, i.e., in principle, attempts are made to produce a temperature gradient in the paper web so that the side that is moistened for control of the curl is colder than the opposite side of the web.

Accordingly, in one embodiment of the method for controlling curl of a web being dried in a dryer section to an ultimate dry solids content, the web is guided through a plurality of curl control stages in which steam is directed at the web or the web is moistened while the web has a dry solids content in a range from K1 to K2 wherein K1 is the ultimate dry solids content −7% and K2 is the ultimate dry solids content +3%, and further, the dryer section is constructed such that during at least one curl control stages, the temperature of the web is lower than 85° C., preferably lower than 75° C. The finishing device may be a coating/surface-sizing device. The method may also entail drying the web in a forward dryer section including drying cylinders and a drying wire for pressing the web over heated faces of said drying cylinders, passing the web from the forward dryer section into a finishing section in which the web is coated/surface-sized by the coating/surface-sizing device, drying the web in an after-dryer arranged after the coating/surface-sizing device, calendering the web in a calender arranged after the after-dryer, and then reeling the web into a machine reel. The forward dryer section and/or the after-dryer may include only normal single-wire draw dryer groups such that the web is dried therein from the side of its bottom face only. The diameter of the drying cylinders and reversing cylinders in a last normal dryer group in the after-dryer may be selected such that the ratio of the diameter of the drying cylinders to the diameter of the reversing cylinders is from about 0.75 to about 2.5.

In certain embodiments, at least one drying cylinder in the last normal dryer group in the after-dryer provides an adjustable temperature of an outer surface thereof over which the web runs, i.e., enables this drying cylinder to be cooled (as opposed to being heated). In this case, the drying wire which carries the web over this drying cylinder preferably carries the web over only this drying cylinder and is cooled. This drying cylinder may be separated in a hood of the dryer section by means of a partition wall arranged therein.

Moreover, in an exemplifying embodiment of the paper or board machine in accordance with the invention, at least two curl regulation devices are arranged in the dryer section for controlling curl of the web, the curl regulation devices being selected from a group consisting of a steam box and a moistening device. At least one curl regulation devices is arranged in each of a plurality of curl control stages. The curl regulation devices are operative on the web while the web has a dry solids content in a range from K1 to K2 wherein K1 is the ultimate dry solids content −7% and K2 is the ultimate dry solids content +3%. Also, the dryer section is structured and arranged such that during at least one curl control stage, the temperature of the web is lower than 85° C., preferably lower than 75° C.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
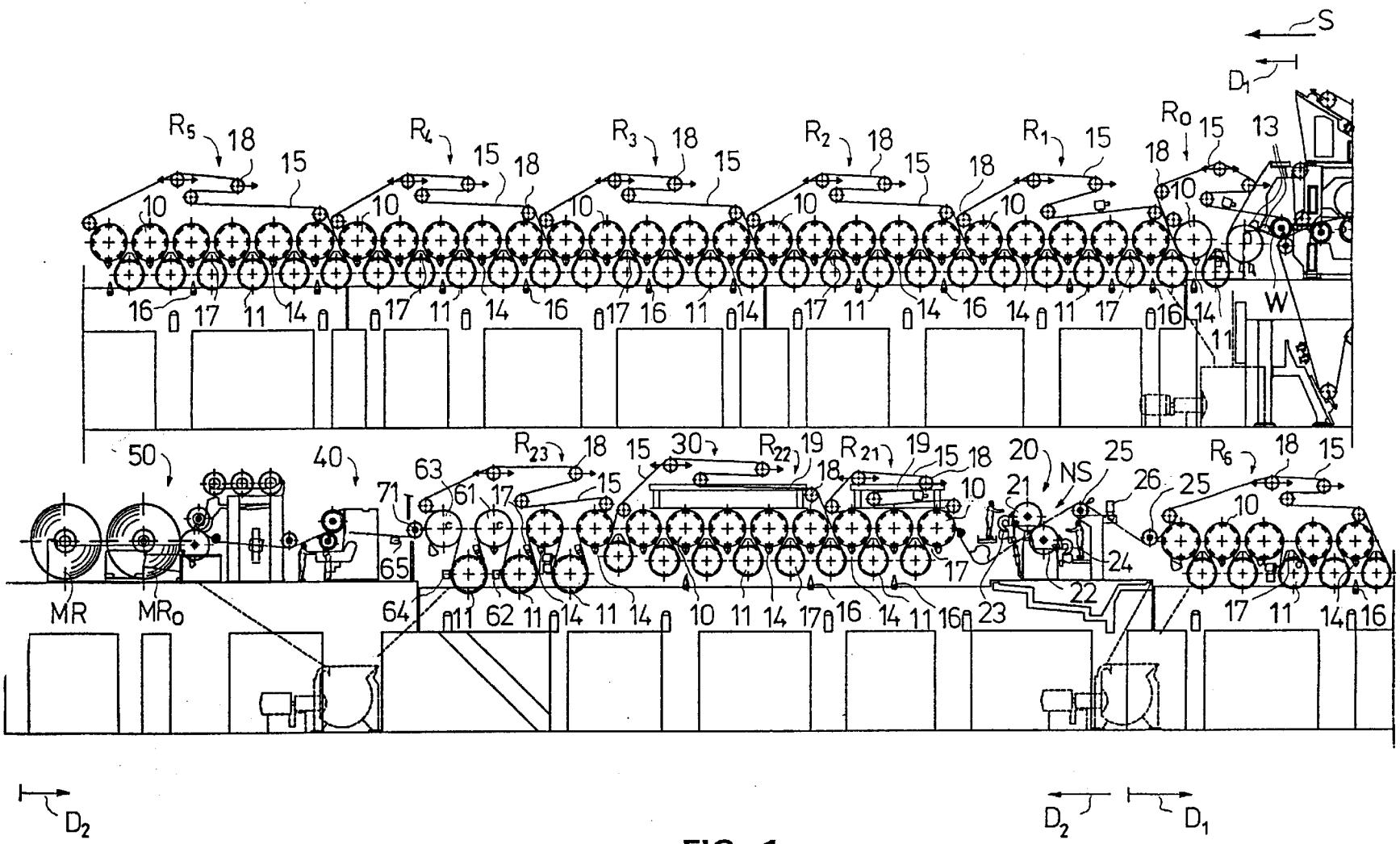
FIG. 1 is a schematic illustration of an exemplifying embodiment of the present invention in respect of the dry end of a paper machine, the dry end of the paper machine being illustrated from the forward dryer section up to the machine reel.
Figure 2:
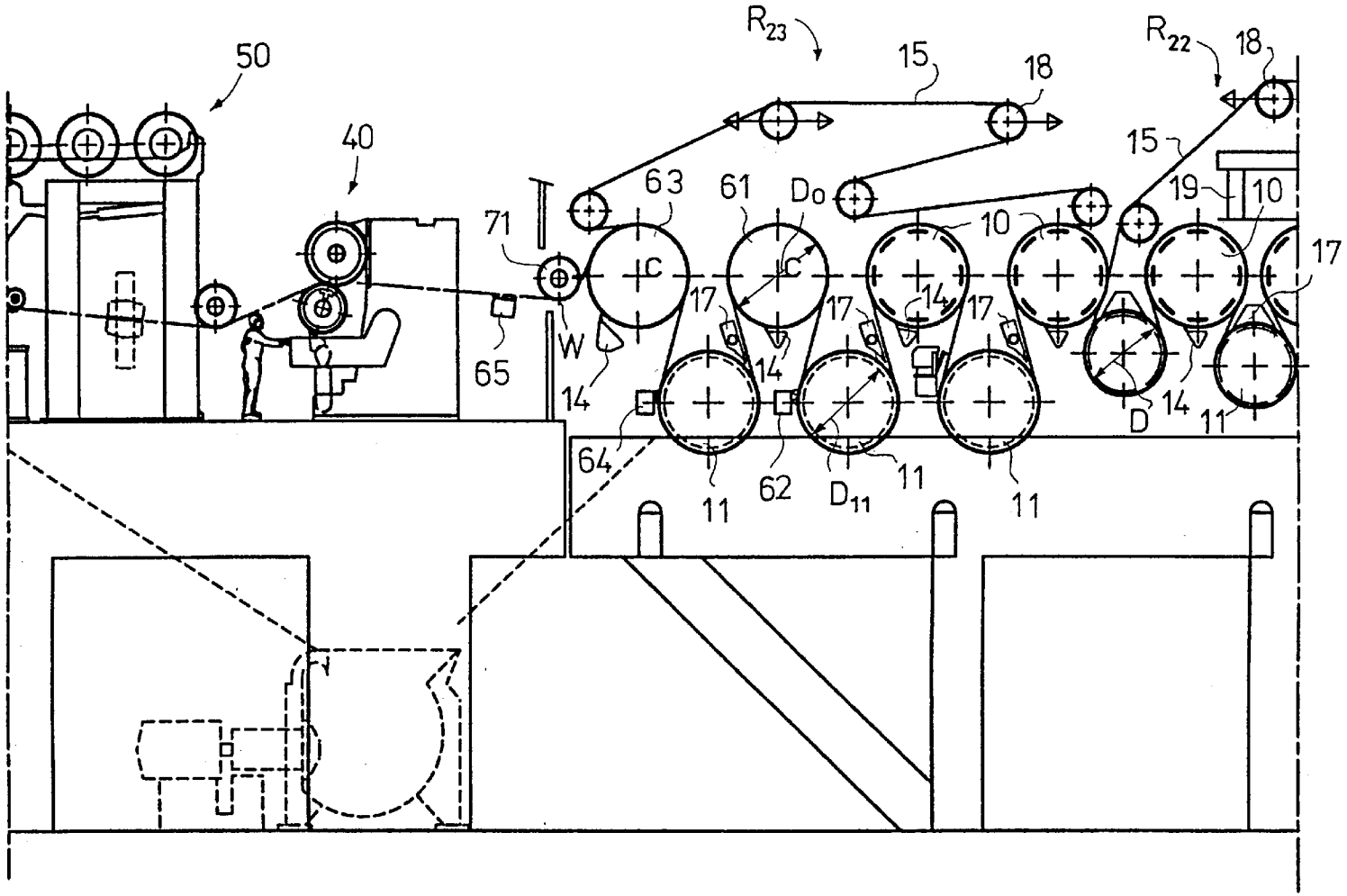
FIG. 2 is a schematic illustration in part of FIG. 1, mainly in respect of the last dryer group in the after-dryer of the finishing section in the dry end of the paper machine.
Figure 3:
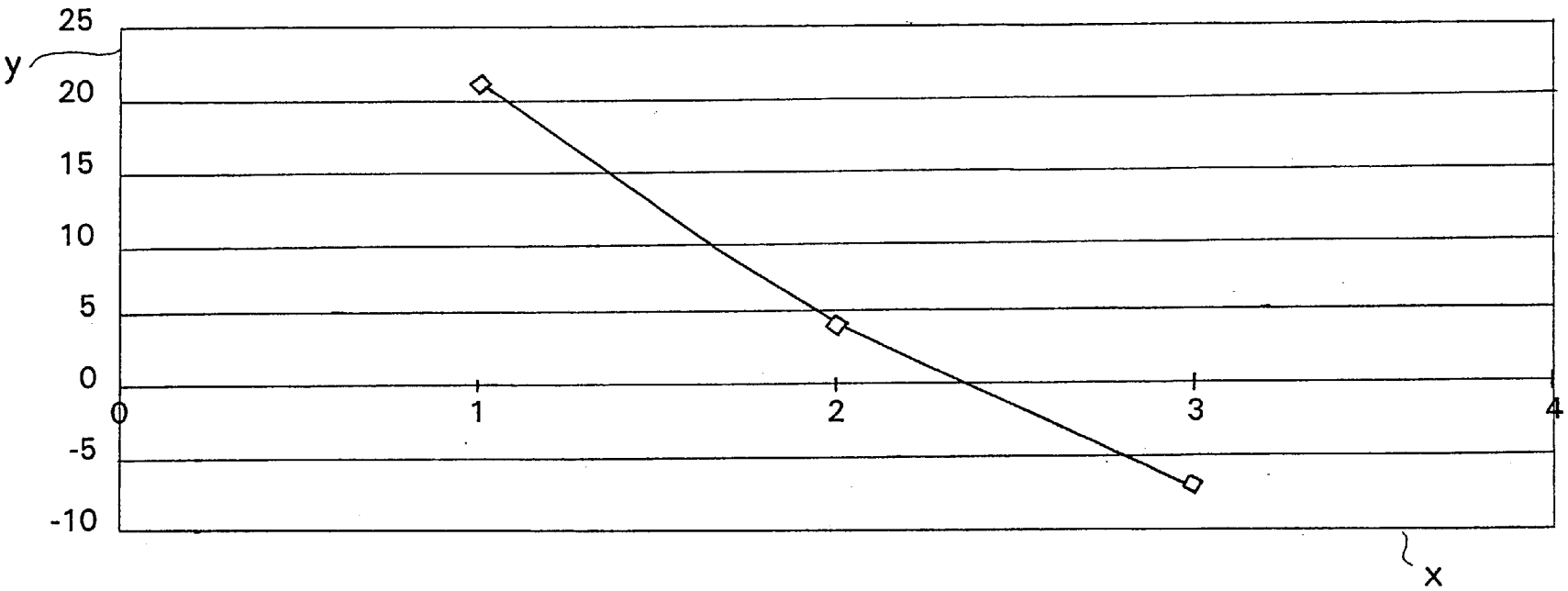
FIG. 3 is a schematic illustration of test results in relation to regulation of the curl in paper by means of water moistening and steam treatment.

Referring to FIGS. 1–3 wherein like reference numerals refer to the same or similar elements, as shown in FIG. 1, a paper web W is brought into a forward dryer section $D_1$ from a press section of the paper machine onto a drying wire 15 of a first group $R_0$ with single-wire draw. The web W adheres to the wire 15 by the effect of a vacuum present in suction boxes 13 arranged in a loop of the wire 15. The forward dryer section $D_1$ includes 7 groups $R_0, \ldots R_6$ with single-wire draw, and the web W has closed draws through the group gaps between these groups. The machine direction, i.e., the direction of progress of the web W, is denoted by arrow S. In the forward dryer section $D_1$ in accordance with the invention, all the groups $R_0, \ldots, R_N$ with single-wire draw are so-called normal groups, in which the drying cylinders 10, e.g., steam-heated smooth-faced drying cylinders, are arranged in an upper substantially horizontal row and reversing suction cylinders 11 are arranged in a lower substantially horizontal row. The number of the dryer groups is generally from 4 to 12, and preferably N is from 6 to 8.

Each normal group $R_0, \ldots, R_N$ has a drying wire 15 of its own which is guided by a respective set of guide rolls 18. The drying wires 15 press the web W to be dried on the drying cylinders 10 against the smooth heated faces of the drying cylinders 10, and on the reversing cylinders 11, the web W remains at the side of the outside curve on the outside face of the wire 15. On the reversing cylinders 11, the web W is kept reliably on the support of the wire 15 against the effect of centrifugal forces by the effect of a vacuum (negative pressure) present on grooved faces of the reversing cylinders 11 or on the perforated mantle of an equivalent suction roll, whereby cross-direction shrinkage of the web W is also counteracted. As reversing suction cylinders 11, suction cylinders marketed by the current assignee with the trade mark "VAC-ROLL"™ are preferably used, which suction cylinders do not include an inside suction box. With respect to the details of the constructions of such suction cylinders, reference is made to the current assignee's Finnish Patent No. 83,680 (corresponding to U.S. Pat. Nos. 5,022, 163 and 5,172,491 incorporated by reference herein).

In the forward dryer section $D_1$ in accordance with a preferred embodiment of the invention, the support contact between the web W and the drying wire 15 is kept adequate also on the straight draws between the drying cylinders 10 and the reversing cylinders 11, at least on the runs from the drying cylinders 10 to the reversing cylinders 11, by arranging blow-suction boxes 17 along these straight draws. By means of the blow-suction boxes 17, the formation of pressures induced by the wire 15 is also prevented in the closing wedge-shaped nip spaces between the wire 15 and the mantles of the reversing cylinders 11. For the purposes herein, blow-suction boxes 17 are understood to designate blow boxes for blowing a medium such as air, whereby the air blowing produces a vacuum, and such blow boxes do not necessarily communicate with sources of negative pressure. With respect to details of the constructions of suitable blow-suction boxes 17, which are marketed by the current assignee with the trade mark "UNO RUN BLOW BOX"™, reference is made to the current assignee's Finnish Patent Nos. 59,637, 65,460 and 80,491 (corresponding to U.S. Pat. Nos. 4,441,263, 4,516,330 and 4,905,380, respectively, incorporated by reference herein). Blow-box constructions of other types, in themselves known, are also included in the scope of the overall concept of the present invention.

In the forward dryer section $D_1$, in the groups $R_0, \ldots, R_N$ with single-wire draw, blow boxes 16 are also employed in the gaps between adjacent reversing cylinders 11. By means of the blow boxes 16, gap spaces between the reversing cylinders 11 are air-conditioned and evaporation of water from the web W is promoted. The faces of the drying cylinders 10 are kept clean by doctors 14 or other suitable surface-cleaning means.

It is another substantial advantage of the forward dryer section $D_1$ used in the invention that in the groups $R_0, \ldots, R_N$ with single-wire draw, which extend over the entire length of the dryer section, removal of broke by the effect of gravity can be applied, for the single-wire groups $R_0, \ldots, R_N$ are open toward the bottom. In this manner, the paper web W that becomes broke can be removed without any special arrangements onto the broke conveyor (not shown) placed in the basement spaces of the paper machine and on this conveyor further into a pulper or pulpers.

With a view toward preventing cross-direction shrinkage of the web W, it is of particular importance that, in the forward dryer section $D_1$, the web W is kept in reliable contact with the drying wires 15 at all times. This holding effect is produced on the reversing cylinders 11 by means of a vacuum present in the grooved mantle 12 or equivalent of the reversing cylinders 11 and, on the straight runs between the cylinders 10 and the reversing cylinders 11, by means of pressure levels arranged by means of the blow-suction boxes 17 and partly also by means of the tension T of the web W in the machine direction, which tension produces a contact pressure $P_K$=T/R(R=radius of the cylinders 11) between the web W and the wires 15.

As stated above, as the reversing cylinders 11 in the forward dryer $D_1$, favorably the current assignee's VAC-ROLL™ rolls are used. In these rolls, the vacuum effect is spread through the perforations on the reversing cylinders 11 onto the grooved mantle so that the wedge-shaped nip spaces between the reversing cylinders 11 and the drying wire can also be evacuated efficiently. In this manner, pressures cannot be induced into these wedge spaces, which pressures would attempt to separate the web W from the drying wire when the web W is placed outside. In the alternative, if suction rolls provided with inside suction boxes are used as the reversing cylinders 11 in the forward dryer section $D_1$, the suction zone should preferably be extended over an area wider than the turning sector of the drying wire 15 and the web, so that the suction effect and the free flow of air can be extended into the wedge spaces, for the purposes mentioned above.

Besides the forward dryer section $D_1$ described above, the dry end of a paper machine in accordance with the invention includes a finishing section $D_2$ arranged after the forward dryer section $D_1$ in the machine direction. The finishing section $D_2$ includes a machine reel-up 50, for example a Pope-type reel-up. A machine reel that is being produced on-line by means of the reel-up 50 is denoted by reference $MR_O$, and one complete machine reel is denoted by reference MR. The web W is brought to the machine reel-up 50 through a calender 40 from an after-dryer 30, which is placed after a coating/surface-sizing device 20 in the finishing section $D_2$. The web is calendered in the calender 40 and coated or surface-sized in the coating/surface-sizing device 20.

In the finishing section $D_2$ after the forward dryer section $D_1$, the paper web W, which has been dried in the forward dryer section $D_1$ to a dry solids content $k_2$ from about 96% to about 99%, is passed over paper guide rolls 25 and over a measurement beam 26 arranged between the guide rolls 25 into the coating/surface-sizing device 20. The measurement beam 26 measures the property profiles of the paper. Coating device 20 is, for example, a coating device marketed by the current assignee with the name Sym-Sizer™. The coating device 20 includes two coating rolls 21 and 22 arranged one opposite to the other, and size feed devices 23 and 24 arranged in connection with a respective one of the rolls so that the paper web W is coated from both sides in a coating nip NS defined between the rolls 21 and 22. Owing to the use of a water-containing coating agent, the web W is partly moistened in the coating nip NS from both sides. Then, the web W, which was dried in the forward dryer $D_1$ asymmetrically from the side of its bottom face W and which has a tendency of curling, is treated into such a state that its internal strains are partly relaxed or at least substantially reduced.

In the exemplifying embodiment shown in FIG. 1, the after-dryer 30 in the finishing section $D_2$ is also exclusively composed of dryer groups $R_{21}$, $R_{22}$, $R_{23}$ with single-wire draw. The last dryer group $R_{23}$ in the after-dryer 30, in which group the curl control arrangements are arranged, will be described in more detail in relation to FIG. 2. The first two groups $R_{21}$, $R_{22}$, which are provided with a possibility of impingement blowing 19, are basically similar to the dryer groups $R_0, \ldots, R_6$ in the forward dryer $D_1$, and the same reference numerals are used for corresponding parts.

As shown in FIG. 2, the last dryer group $R_{23}$ in the after-dryer first includes a drying cylinder 10 in the group gap and a following reversing roll or cylinder 11 and further a second drying cylinder 10 and a following reversing cylinder 11. After this, there follows a cylinder 61 constructed to provide an adjustable temperature of its outer surface, preferably a cylinder that can be cooled. After cylinder 61, the web W is passed onto the reversing roll or cylinder 11 in the lower row and onto a second cylinder 63 constructed to provide an adjustable temperature, preferably a cooling cylinder. The drying wire is denoted by the reference numeral 15, and its guide rolls are denoted by reference numeral 18, the runnability components are denoted by the reference numeral 17, and the doctors are denoted by the reference numeral 14, as is the case in FIG. 1. At the outlet side of the last two reversing rolls or cylinders 11 in the last dryer group $R_{23}$ in the after-dryer 30, before the cylinders 61,63 of adjustable temperature, preferably a moistening device 62 and a steam treatment device such as a steam box 64 are placed. Both devices can, of course, be both moistening or steam treatment devices.

The paper web W is thus moistened/steam-treated in a respective curl control stage before the web W is passed onto the cylinders 61,63, which are preferably cooled cylinders. From the latter cooling cylinder 63, the web W is passed past a steam box 65 (which may in the alternative be a moistening device) situated after a guide roll 71 to the calender 40 and further to the reel-up 50.

In accordance with the present invention, by means of alternation of moistening/steam-treatment devices 62,64 and cooling of the web W by means of cooling cylinders 61,63, a regulation of the curl in several steps or stages has been achieved, in which case it is highly efficient. In each of these stages, the dry solids content of the web W is in the range of K1--K2, wherein K1 is ultimate dry solids content −7% and K2 is the ultimate dry solids content +3%. Also, in at least one of these curl control stages, the temperature of the web at the steam box 64 is lower than 85° C., preferably lower than about 75° C. This is achieved by appropriate construction and arrangement of the components of the dryer section. The temperature of the web at the steam box 65 is also lower than 85° C., preferably lower than about 75° C.

As shown in FIG. 2, the diameter $D_{11}$ of the reversing rolls or cylinders 11 in the last dryer group $R_{23}$ is larger than the diameter D of the reversing rolls or cylinders 11 in the preceding groups. In order to regulate the tendency of curling of the web, in the last dryer group $R_{23}$, the diameter ratio of the diameter $D_{11}$ of the reversing cylinder 11 to the diameter $D_0$ of the drying cylinders 10/cooling cylinders 61,63 is selected such that the web W is also cooled in this way on the face of the reversing cylinder 11 of a diameter larger than usual so as to intensify the effect of regulation of the curl. The diameter ratio $D_0/D_{11}$ is from about 0.75 to about 2.5, preferably from about 1.0 to about 1.5.

Since attempts are made to cool the web by means of cylinders of a lower temperature placed in the end of the dryer section and possibly by using larger reversing cylinders, it is also advantageous to employ a wire circulation for these cylinders. In this way, the other, heatable cylinders and the long wire circulation cannot heat the wire and, thereby, the web in the end of the dryer section. In order to provide additional capacity, the wire can be cooled further, for example, by blowing cold air.

Even though it is not illustrated in the drawings, the dryer section may be placed inside a hood, in a conventional manner, to enable the recovery of moist air, to improve the energy economy, and to intensify the air-conditioning of the dryer section. In particular, when a wire circulation of its own is employed in the end, it is preferable to isolate this area from the rest of the hood by means of a partition wall. By means of this proposed construction, the wire is kept colder and both the energy efficiency and the operability of the air-conditioning of the dryer section are improved.

It has also been recognized that from the point of view of the ultimate properties of the paper, it is advantageous that the curl regulation operations are carried out when the web is supported, e.g., against the drying wire, as shown in FIGS. 1 and 2. The final result is also better when the web is subjected to a draw either in the machine direction or in the cross direction. In FIG. 2, the web is drawn between the last drying cylinder and the calender, i.e., the web is subjected to a tension in the machine direction when it is steam-treated/moistened by means of the device 65.

FIG. 3 is a schematic illustration of test results related to regulation of the curl of paper by means of water moistening and steam treatment. The Y axis represents the curl, and the X axis represents the test points 1 to 3. In the test point 1, one-sided drying has been used, in the test point 2 one-sided drying and steam-treatment have been used, and in the test point 3 one-sided drying, water moistening and steam-treatment have been used. When the sign of the curl is positive, the curling takes place towards the top side, and when the sign of the curl is negative, the curling takes place towards the bottom side. As shown in FIG. 3, a one-sidedly dried web curls intensively (20 units). Steam treatment alone at one stage reduces the curl substantially, but the web still curls in the original direction by about five units. When the web has been moistened slightly before steam treatment, the web curl direction can be even reversed.

Even though the invention is preferably applied in connection with the dryer section solution described in the exemplifying embodiments, the invention is by no means supposed to be strictly confined to these constructions, but the invention can also be utilized in connection with conventional cylinder dryer concepts or while using drying other than cylinder drying, such as, for example, impingement drying.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A method in a dryer section of a paper or board machine for controlling curl of a web being dried therein to an ultimate dry solids content, the web being worked in a finishing device after the dryer section, comprising the steps of:

while the web has a dry solids content in a range from K1 to K2 wherein K1 is the ultimate dry solids content −7% and K2 is the ultimate dry solids content +3%, guiding the web through a plurality of curl control stages in which steam is directed at the web or the web is moistened, and constructing the dryer section such that during at least one of said curl control stages, the temperature of the web is lower than 85° C.

2. The method of claim 1, wherein the dryer section is constructed such that during said at least one curl control stage, the temperature of the web is lower than 75° C.

3. The method of claim 1, wherein the finishing device is a coating/surface-sizing device, further comprising the steps of:

drying the web in a forward dryer section including drying cylinders and a drying wire for pressing the web over heated faces of said drying cylinders, passing the web from the forward dryer section into a finishing section in which said coating/surface-sizing is situated, coating/surface-sizing the web in the finishing section by means of said coating/surface-sizing device, drying the web in an after-dryer arranged after said coating/surface-sizing device, calendering the web in a calender arranged after the after-dryer, and then reeling the web into a machine reel.

4. The method of claim 3, wherein said forward dryer section includes only normal single-wire draw dryer groups such that the web is dried in the forward dryer section from the side of its bottom face.

5. The method of claim 3, wherein said after-dryer includes normal single-wire draw dryer groups such that the web is dried in the after-dryer from the side of its bottom face, each of said normal single-wire draw dryer groups including drying cylinders arranged in a first row, reversing cylinders arranged in a second row below said first row, and a drying wire for carrying the web over said drying cylinders and said reversing cylinders.

6. The method of claim 5, further comprising the step of:

selecting the diameter of said drying cylinders and said reversing cylinders in a last one of said normal dryer groups in said after-dryer in a running direction of the web such that the ratio of the diameter of said drying cylinders to the diameter of said reversing cylinders in said last normal dryer group in said after-dryer is from about 0.75 to about 2.5.

7. The method of claim 5, wherein at least one of said drying cylinders in a last one of said normal dryer groups in said after-dryer in a running direction of the web is structured and arranged to provide an adjustable temperature of an outer surface thereof over which the web runs.

8. The method of claim 7, wherein said at least one drying cylinder providing an adjustable temperature is structured and arranged to be cooled.

9. The method of claim 7, wherein said last normal dryer group is structured and arranged such that said drying wire which carries the web over said at least one drying cylinder providing an adjustable temperature carries the web over only said at least one drying cylinder providing an adjustable temperature.

10. The method of claim 9, further comprising the step of:

separating said at least one drying cylinder providing an adjustable temperature in a hood of the dryer section by means of a partition wall arranged in said hood.

11. The method of claim 9, further comprising the step of:

cooling said drying wire which carries the web over only said at least one drying cylinder providing an adjustable temperature.

12. The method of claim 3, wherein said after-dryer includes dryer groups each having drying cylinders, reversing cylinders and a drying wire for carrying the web over said drying cylinders and said reversing cylinders, said step of guiding the web through a plurality of curl control stages comprising the steps of:

arranging a moistening device in a last one of said dryer groups in said after-dryer in a running direction of the web, passing the web in front of said moistening device such that the web is moistened, the moistening of the web constituting a first one of said curl control stages, thereafter passing the web along a cylinder face of a first one of said drying cylinders, said first drying cylinder being arranged to provide an adjustable temperature of said cylinder face thereof along which the web runs, passing the web from said first drying cylinder to one of said reversing cylinders, arranging a steam box or a moistening device in connection with said one of said reversing cylinders such that the web is steam-treated or moistened as it passes over said one of said reversing cylinders, the steam-treatment or moistening of the web constituting a second one of said curl control stages, and thereafter passing the web along a cylinder face of a second one of said drying cylinders, said second drying cylinder being arranged to provide an adjustable temperature of said cylinder face thereof along which the web runs.

13. The method of claim 12, further comprising the steps of:

arranging a steam box or a moistening device after said second cylinder to steam-treat or moisten the web, and then passing the web to the calender.

14. The method of claim 12, further comprising the step of:

drying the web prior to said first curl control stage to a dry solids content between about 96% and about 99%.

15. The method of claim 1, further comprising the step of:

during said curl control stages, supporting the web or directing the web in a draw in the machine direction.

16. The method of claim 1, further comprising the step of:

subjecting the web to a spreading effect during or directly after said curl control stages.

* * * * *